United States Patent [19]

Minagawa et al.

[11] 3,996,055

[45] Dec. 7, 1976

[54] COLOR PHOTOGRAPHIC LIGHT-SENSITIVE MATERIAL

[75] Inventors: Yoshisato Minagawa; Akio Okumura, both of Minami-ashigara, Japan

[73] Assignee: Fuji Photo Film Co., Ltd., Minami-ashigara, Japan

[22] Filed: Dec. 23, 1974

[21] Appl. No.: 535,752

[30] Foreign Application Priority Data

Dec. 21, 1973 Japan ..... 49-3113

[52] U.S. Cl. ..... 96/74; 96/9; 96/55; 96/95; 96/100

[51] Int. Cl.[2] ..... G03C 1/76

[58] Field of Search ..... 96/9, 74, 100

[56] References Cited

UNITED STATES PATENTS

| | | | |
|---|---|---|---|
| 3,615,602 | 10/1971 | Credner et al. | 96/100 |
| 3,642,485 | 2/1972 | Oishi et al. | 96/74 |
| 3,658,545 | 4/1972 | Iwama et al. | 96/9 |
| 3,784,383 | 1/1974 | Iwama et al. | 96/9 |
| 3,811,892 | 5/1974 | Kagami et al. | 96/9 |

*Primary Examiner*—J. Travis Brown

*Attorney, Agent, or Firm*—Sughrue, Rothwell, Mion, Zinn & Macpeak

[57] ABSTRACT

A color photographic light-sensitive material, comprising a support having thereon at least one silver halide emulsion and the light sensitive material containing a colored cyan coupler having a main absorption in the blue region of the spectrum and a colored cyan coupler having a main absorption in the green region of the spectrum, and a colorless cyan coupler, each coupler being capable of coupling with an oxidation product of a p-phenylenediamine color-developing agent to form a cyan dye.

10 Claims, 3 Drawing Figures

COLOR PHOTOGRAPHIC LIGHT-SENSITIVE MATERIAL

BACKGROUND OF THE INVENTION

1. Field of the Invention

The present invention relates to a color photographic light-sensitive material, and, more particularly to a silver halide color negative light-sensitive material capable of providing a color print dye image having excellent color reproducibility.

2. Description of the Prior Art

It is well known that, when a silver halide color photographic material is color-developed, a color-forming coupler couples with an oxidation product of an aromatic primary amine developing agent to form a dye image of an indophenol, indamine, azomethine, phenoxazine, phenazine or a like structure. In this system, a color reproduction process based on subtractive color photography is usually employed, and a cyan dye image, a magenta dye image and a yellow dye image, which are in a complementary relationship with the original red, green and blue, respectively, of the object photographed, are formed. Usually, phenolic couplers (i.e., phenols and naphthols) are used for the formation of a cyan-dye image, pyrazolone or cyanoacetyl couplers are used for the formation of a magenta dye image, and acylacetamides or benzoylmethane couplers are used for the formation of a yellow dye image.

The thus formed dye image does not possess theoretically ideal spectral absorption characteristics. For example, a cyan dye image generally has side-absorptions of green light and blue light, although it should only absorb red light. Also, a magenta dye image generally has side-absorptions of blue light and red light, although it should only absorb green light. A yellow dye image has comparatively small side-absorption as compared with the above-described cyan and magenta dye images. Such side-absorptions are not advantageous for the color reproducibility of a light-sensitive material. As a process for removing this defect, a so-called masking process using a colored color-forming coupler has been put into practice in this field (for example, as disclosed in U.S. Pat. No. 2,428,054). Color prints obtained from the masked color negative images have excellent color reproducibility.

According to the masking process, as described in U.S. Pat. No. 2,428,054, etc., it is desirable to use a cyan coupler which is colored so that it has absorption in the blue region and the green region (hereinafter referred to as "colored cyan coupler) in combination with a colorless cyan coupler, in order to remove the above-described cyan dye side-absorptions.

Colored cyan couplers are described in U.S. Pat. Nos. 3,481,741, 3,459,552, 3,583,971, 2,455,169, 3,034,892, etc. However, these colored cyan couplers have the defect that those cyan couplers which have sufficient absorption in the blue region have insufficient absorption in the green region while those which have sufficient absorption in the green region have insufficient absorption in the blue region. Therefore, these colored couplers have insufficient masking properties.

SUMMARY OF THE INVENTION

Therefore, an object of the present invention is to provide a silver halide color negative photographic light-sensitive material having good color reproducibility.

Another object of the present invention is to provide a process for effecting color correction of a cyan dye through masking using a colored cyan coupler having an unsatisfactory spectral absorption characteristics when the colored cyan coupler is used alone.

These and other objects are attained with both a colored cyan coupler having a main absorption in the blue region and a colored cyan coupler having a main absorption in the green region in combination with a colorless cyan coupler.

The color light-sensitive material of the present invention comprises a support having thereon at least one silver halide photographic emulsion layer containing a color coupler, wherein the silver halide emulsion layer sensitive to red light contains in combination a colored cyan coupler having a main absorption in the blue region of the spectrum, a colored cyan coupler having a main absorption in the green region of the spectrum, and a colorless cyan coupler.

DETAILED DESCRIPTION OF THE INVENTION

Figure 1:
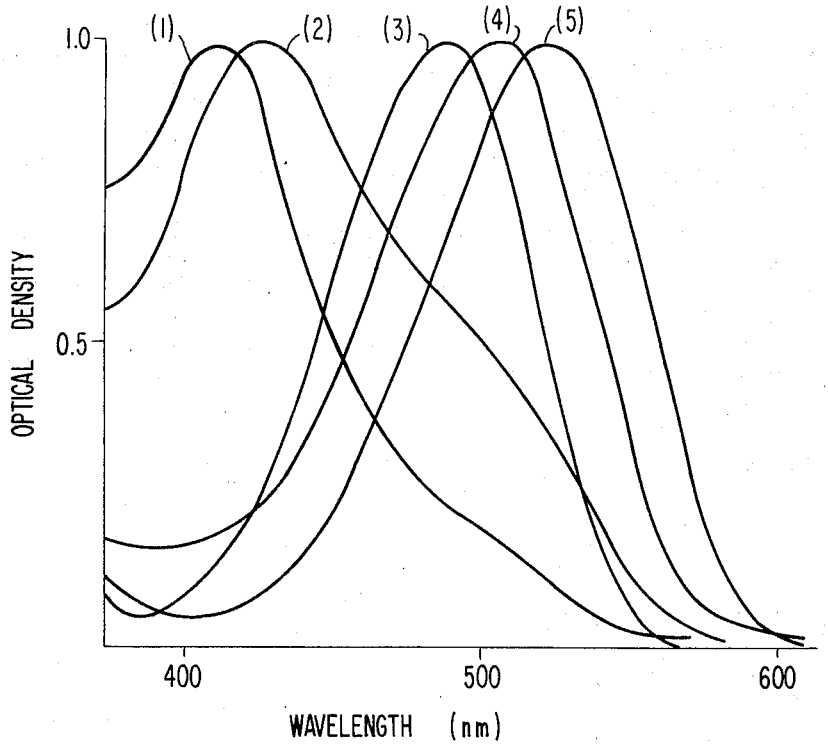
FIG. 1 shows the spectral absorption curves of 5 typical compounds of colored cyan couplers having a main absorption in the blue region and colored cyan couplers having a main absorption in the green region measured in an organic solvent (tricresylphosphate), wherein Curves (1), (2), (3), (4) and (5) are the spectral absorption spectra of Compounds (31), (35), (41), (4) and (21), respectively.

The colored cyan couplers of the present invention having a main absorption in the blue region are those couplers which have an absorption peak in the wavelength range of about 390 to 490 nm, and the colored cyan couplers having a main absorption in green region are those couplers which have an absorption peak in the wavelength range of about 490 to 550 nm.

In the combined use of these colored cyan couplers, the wavelength difference between the peaks of the two colored couplers is not less than about 10 nm, preferably not less than about 18 nm. These colored cyan couplers and the colorless cyan coupler are all incorporated in a red-sensitive layer and all react with an oxidation product of a p-phenylenediamine color developing agent to form a cyan dye image.

The colored cyan couplers of the present invention are illustrated below. Preferable examples of the colored cyan coupler having a main absorption in green region are illustrated by the couplers represented by the following general formula (I)

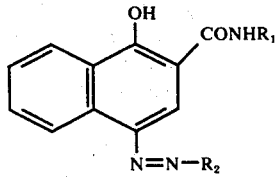

(I)

wherein $R_1$ represents an aryl group; $R_2$ represents an aryl group having at least one of an alkoxycarbonyl group, an aryloxycarbonyl group, an alkylcarbonyl group or an arylcarbonyl group as a substituent; and preferable examples of the colored cyan coupler having a main absorption in the green region are illustrated by the couplers represented by the following general formula (II)

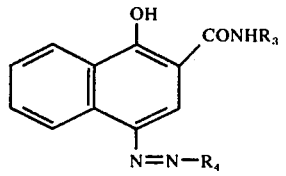

(II)

wherein $R_3$ represents an alkyl group; $R_4$ represents a monocyclic aryl group containing an alkoxycarbonyl group, an aryloxycarbonyl group, an alkylcarbonyl group or an arylcarbonyl group at the o-position with respect to the azo group.

In the above described general formula (I) and (II) $R_1$ represents an aryl group (e.g., a phenyl group, a biphenyl group, a terphenyl group, a naphthyl group particularly an α-naphthyl group, etc.) which can be unsubstituted or substituted with one or more of an alkyl group having 1 to 32 carbon atoms, a halogen atom, an alkoxy group having 1 to 32 carbon atoms, an acyloxy group, an alkoxycarbonyl group having 2 to 32 carbon atoms, an aryloxycarbonyl group, an acylamino group, an arylcarbonylamino group, a cycloalkylcarbonylamino group, an alkylamino group, an arylamino group, an N-alkylcarbamoyl group, an N-arylcarbamoyl group, an N-alkylureido group, an N-arylureido group, an alkylthio group, an arylthio group, an N-alkylsulfamoyl group, an N-arylsulfamoyl group, an alkylsulfonylamino group, an arylsulfonylamino group, a sulfo group, a carboxy group, a cycloalkylamino group, a cyclic amino group, an alkylcarbonyl group, an arylcarbonyl group, an alkylsulfonyl group, an arylsulfonyl group, a nitro group, a cyano group, a hydroxyl group, a mercapto group, a heterocyclic group, a sulfino group, a fluoroformyl group, a fluorosulfonyl group, or perfluoroalkyl group having 1 to 18 carbon atoms as substituents; $R_2$ represents an aryl group (e.g., a phenyl group, a biphenyl group, a terphenyl group, or a naphthyl group) which has as a substituent at least one of an alkoxycarbonyl group having 1 to 32 carbon atoms or further additionally having as substituent one or more of an aryl group, an alkenyl group, an alkoxy group having 1 to 32 carbon atoms, an aryloxy group, an alkoxycarbonyl group, an aryloxycarbonyl group, an acylamino group, an arylcarbonylamino group, a cycloalkylcarbonylamino group, an alkylamino group, an arylamino group, an N-alkylcarbamoyl group, an N-arylcarbamoyl group, an N-alkylureido group, an N-arylureido group, an alkylthio group, an arylthio group, an N-alkylsulfamoyl group, an N-arylsulfamoyl group, an alkylsulfonylamino group, an arylsulfonylamino group, a sulfo group, a carboxy group, a cycloalkylamino group, a cyclic amino group, an alkylcarbonyl group, an arylcarbonyl group, an alkylsulfonyl group, an arylsulfonyl group, a nitro group, a cyano group, a hydroxy group, a mercapto group, a heterocyclic group, a sulfino group, a fluoroformyl group, a fluorosulfonyl group, or a perfluoroalkyl group having 1 to 18 carbon atoms); of an aryloxycarbonyl group (e.g., a phenyloxycarbonyl group, a biphenyloxycarbonyl group, a naphthyloxycarbonyl group, etc.) in which the aryl group may be unsubstituted or substituted with one or more substituents as defined for $R_1$; of an alkylcarbonyl group which may be unsubstituted or substituted with one or more substituents as defined for the alkoxycarbonyl group described above; and of an arylcarbonyl group which may be unsubstituted or substituted with one or more substituents as defined for the aryloxycarbonyl group described above; $R_3$ represents an alkyl group having 1 to 32 carbon atoms which may be unsubstituted or substituted with one or more of an aryl group, an alkenyl group, an alkoxy group, an aryloxy group, an alkoxycarbonyl group, an aryloxycarbonyl group, an acylamino group, an arylcarbonylamino group, a cycloalkylcarbonylamino group, an alkylamino group, an arylamino group, an N-alkylcarbamoyl group, an N-arylcarbamyl group, an N-alkylureido group, an N-arylureido group, an alkylthio group, an arylthio group, an N-alkylsulfamoyl group, an N-arylsulfamoyl group, an alkylsulfonylamino group, an arylsulfonylamino group, a sulfo group, a carboxy group, a cycloalkylamino group, a cyclic amino group, an alkylcarbonyl group, an arylcarbonyl group, an alkylsulfonyl group, an arylsulfonyl group, a nitro group, a cyano group, a hydroxyl group, a mercapto group, a heterocyclic group, a sulfino group, a fluoroformyl group, a fluorosulfonyl group, a perfluoroalkyl group, a perfluoroalkoxy group, a perfluoroalkoxycarbonyl group, a perfluoroacylamino group, a perfluoroalkylamino group, an N-perfluoroalkylcarbamoyl group, an N-perfluoroalkylureido group, a perfluoroalkylthio group, an N-perfluoroalkylsulfamoyl group, a perfluoroalkylsulfonylamino group, a perfluoroalkylcarbonyl group, or a perfluoroalkylsulfonyl group; and $R_4$ represents a monocyclic aryl group (e.g., a phenyl group, a naphthyl group etc.) containing at least one of the same substituents at the o-position with respect to the azo group, as the substituents of $R_2$.

Of the couplers represented by the above general formulae (I) and (II), examples of colored cyan couplers which are particularly preferred for the objects of the present invention are illustrated below.

A. Colored cyan couplers as described in U.S. Pat. 3,481,741, i.e., the compounds represented by the following general formula (III) which are particularly preferred as couplers of the above general formula (II) for the objects of the present invention

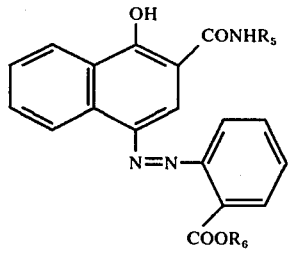

(III)

wherein $R_5$ represents a branched alkyl group having 6 to 22 carbon atoms; and $R_6$ represents a lower alkyl group having 1 to 6 carbon atoms.

Of these colored cyan couplers, particularly useful coupler compounds are shown below.

(1)

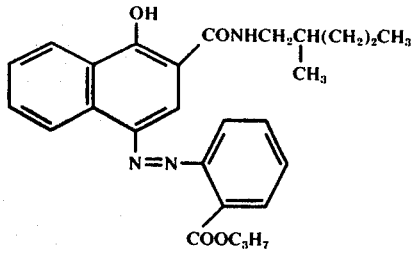

(2)

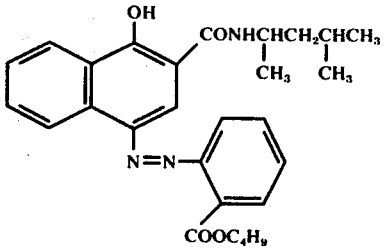

(3)

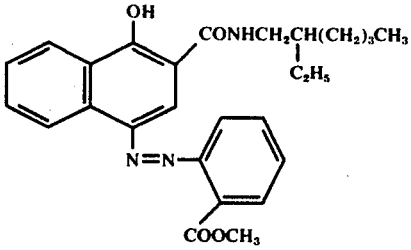

(4)

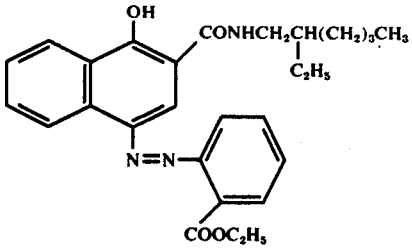

(5)

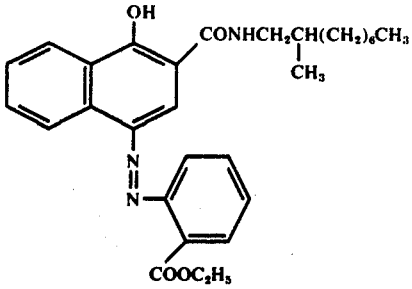

-continued (6)

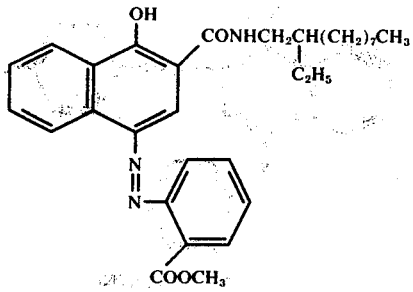

(7)

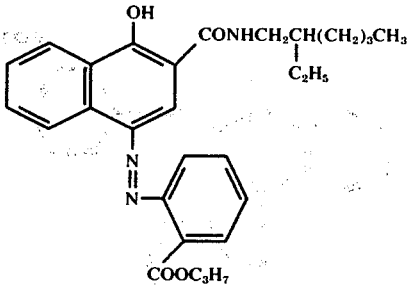

B. Colored cyan couplers as described in U.S. Pat. No. 3,459,552, i.e., the compounds represented by the following general formula (IV) which are particularly preferred as couplers of the general formula (I) for the objects of the present invention

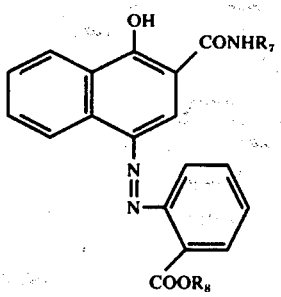

(IV)

wherein $R_7$ represents a monocyclic aryl group having at least one alkoxycarbonyl group having 9 to 22 carbon atoms; and $R_8$ represents a lower alkyl group having 1 to 6 carbon atoms.

Of these colored cyan couplers, particularly useful coupler compounds are shown below.

(8)

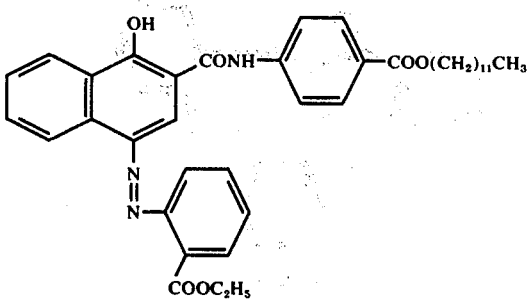

-continued
(9)
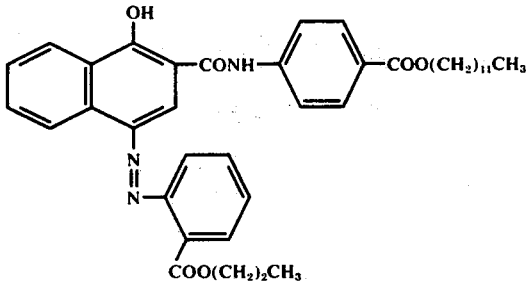
(10)
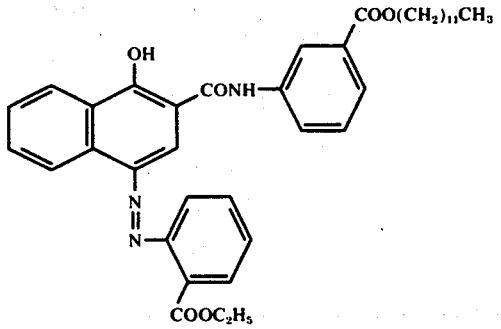
(11)
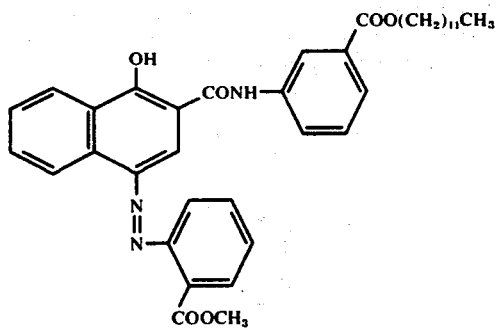
(12)
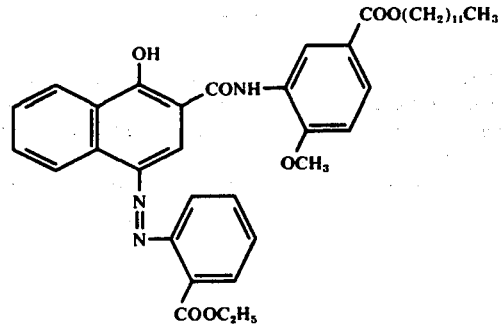
(13)
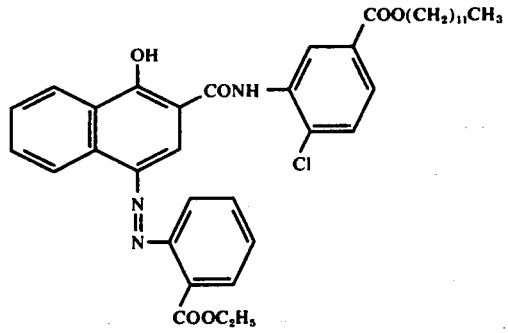

-continued
(14)
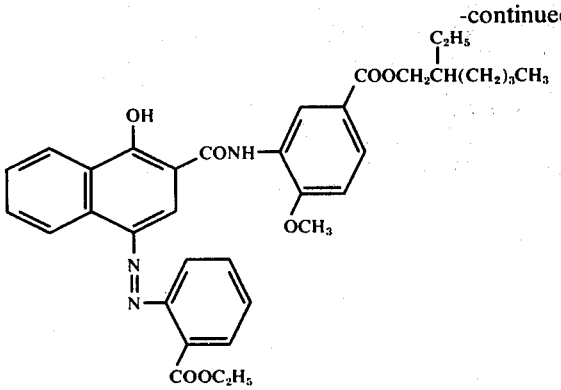
(15)
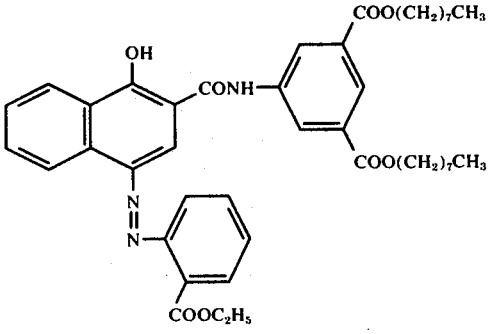
(16)
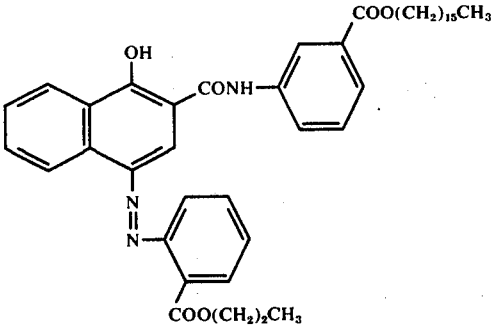
(17)
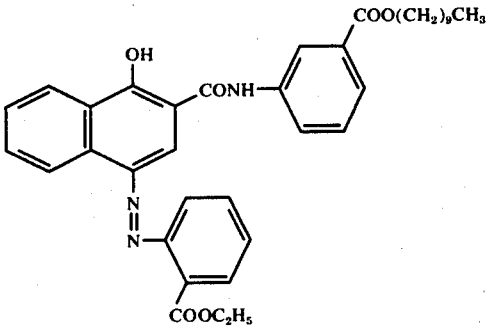
(18)
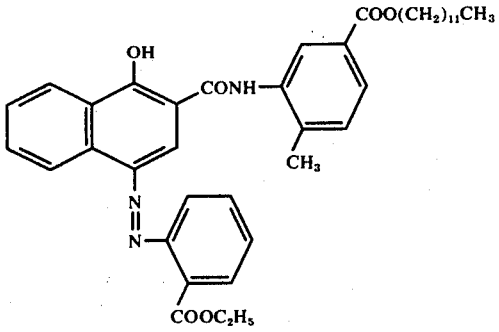

C. Colored cyan couplers described in U.S. Pat. No. 3,583,971, i.e., the compounds represented by the following general formula (V) which are particularly preferred as couplers of the above general formula (I) for the objects of the present invention

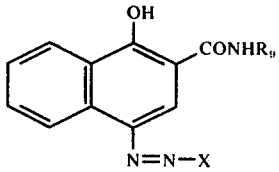

(V)

wherein $R_9$ represents a substituted or unsubstituted naphthalene ring residue connected to the amido group at the α-position thereof; and X represents an aryl group having at least one alkoxycarbonyl group containing 2 to 22 carbon atoms.

Of these colored cyan couplers, particularly useful coupler compounds are shown below.

(19)

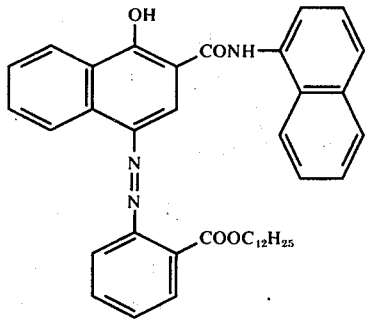

(20)

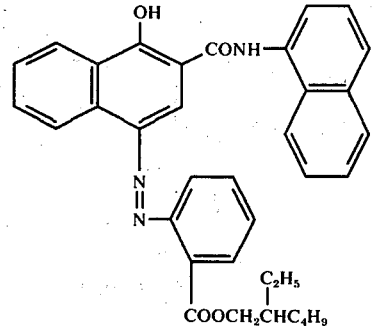

(21)

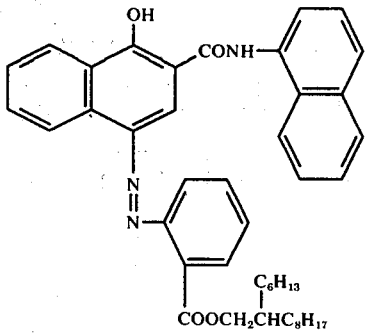

(22)

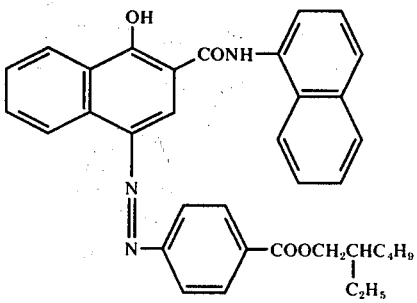

-continued (23)

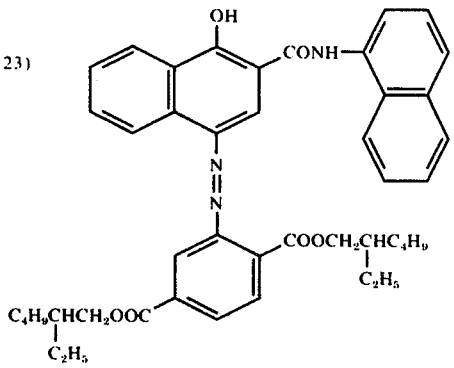

(24)

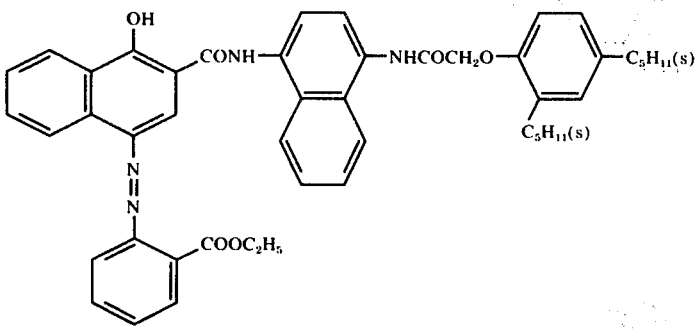

(25)

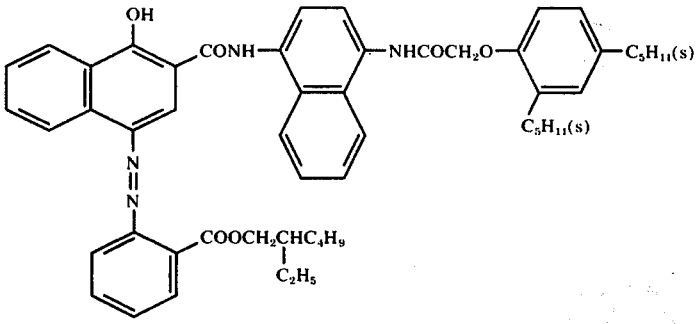

D. Colored cyan couplers as described in U.S. Pat. No. 3,034,892 and represented by the following general formula (VI) which are particularly preferred couplers of the above general formula (I) and (II) for the objects of the present invention (VI)

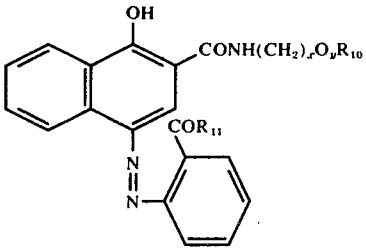

wherein $x$ represents an integer of 0 to 4; y represents 0 or 1; $R_{10}$ represents an aryl group or an alkyl group having 6 to 22 carbon atoms (with the term aryl group including a phenyl group, an alkyl-substituted phenyl group), and $R_{11}$ represents a straight-chain or branched-chain alkyl group having 1 to 4 carbon atoms.

Of these colored cyan couplers, particularly useful coupler compounds are shown below.

(26)
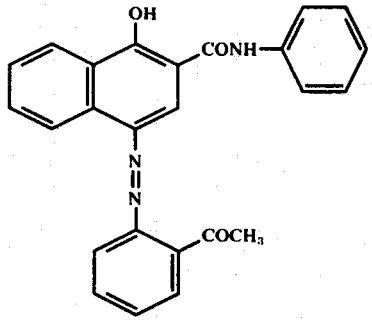
(27)
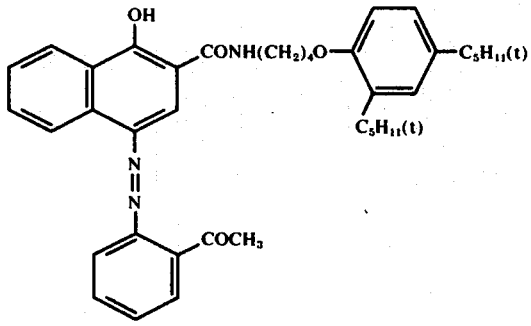
(28)
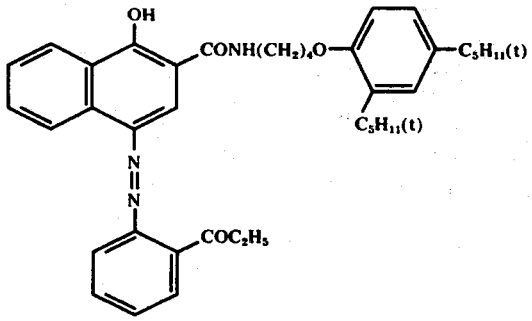
(29)
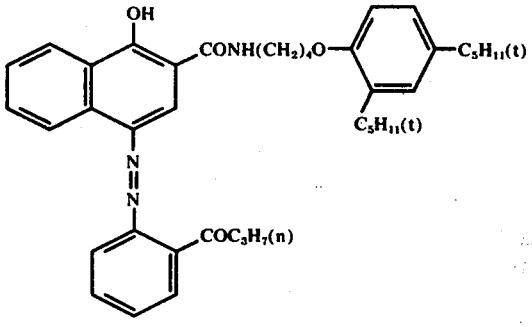
(30)
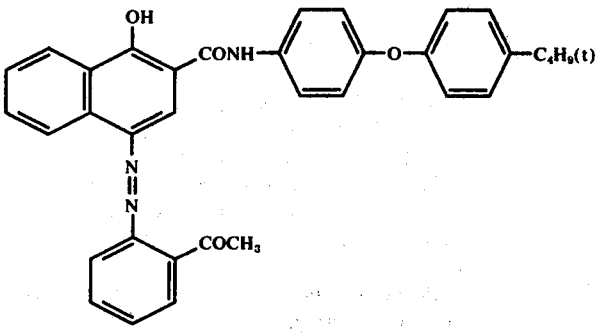

Preferred examples of colored cyan couplers having a main absorption in the blue region are illustrated by the couplers represented by the following general formulae (VII) and (VIII)

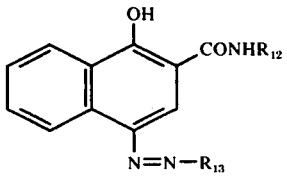

(VII)

wherein $R_{12}$ represents an alkyl group; and $R_{13}$ represents a monocyclic aryl group having an alkoxycarbonyl group or an aryloxycarbonyl group at the m- or p-position with respect to the azo group;

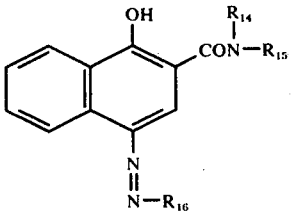

(VIII)

wherein $R_{14}$ represents an alkyl group; $R_{15}$ represents an alkyl group or an aryl group; and $R_{16}$ represents a monocyclic aryl group having at least one of an alkoxycarbonyl group or an aryloxycarbonyl group as a substituent.

In the above general formula (VII) and (VIII) $R_{12}$ represents an alkyl group (i.e., a straight chain or branched chain alkyl group having 1 to 32, conveniently 8 to 16 carbon atoms, which can be unsubstituted or substituted with; e.g., n-dodecyl, 2-methylpentyl, 1,3-dimethylbutyl, 2-ethylhexyl, 3-(n-dodecyloxy)-propyl, 4-(3-pentadecylphenoxy)butyl, 2(2,4-di-t-pentylphenoxy)butyl, 3-(2-ethylhexyloxy)propyl, 2- 2-[2-(2,4-di-t-pentylphenoxy)butyramido]phenyl ethyl, etc.; $R_{13}$ represents a monocyclic aryl group containing the same substituents at the m- or p-position with respect to the azo group as the substituents as defined for $R_4$; $R_{14}$ represents an alkyl group (the same as defined for $R_{12}$; e.g., preferably 2-ethylhexyl, n-octadecyl, methyl etc.); $R_{15}$ represents an alkyl group (i.e., a straight chain or branched chain alkyl group having 1 to 32 carbon atoms) or an aryl group (i.e., a monocyclic aryl group, e.g., a phenyl group, a naphthyl group, etc.) which can be unsubstituted or substituted with; e.g., preferably methyl, n-octadecyl, 2-ethylhexyl, phenyl, 4-(4-t-butylphenoxy)phenyl, 4-[1-(2,4-di-t-pentylphenoxy)butyramido]phenyl, α-phenethyl, 4-(2,4-di-t-pentylphenoxyacetamido)phenethyl, etc.; and $R_{16}$ represents a monocyclic aryl group containing the same substituents as in $R_4$ and $R_{13}$.

Preferred examples of colored cyan couplers having a main absorption in the blue region are illustrated by the compounds represented by the following general formulae (IX) to (XIII) which are particularly preferred as couplers of the above general formulae (VII) and (VIII) for the objects of the present invention

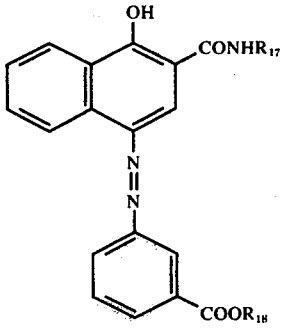

(IX)

wherein $R_{17}$ represents an alkyl group having 6 to 32 carbon atoms which can be further substituted with another substituent (a typical example including an n-hexyl group, an n-octyl group, a 2-ethylhexyl group, an n-dodecyl group, an n-octadecyl group, a γ-(n-dodecyloxy)-n-propyl group and a γ-(2,4-di-t-amylphenoxy)butyl group, etc.); and $R_{18}$ represents an alkyl group having 1 to 20 carbon atoms;

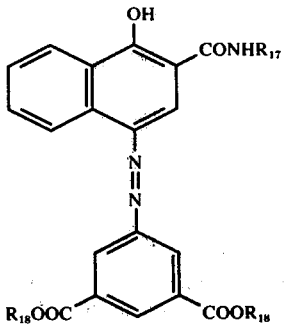

(X)

wherein $R_{17}$ and $R_{18}$ are the same as defined above;

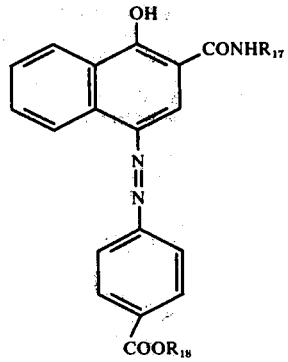

(XI)

wherein $R_{17}$ and $R_{18}$ are the same as defined above;

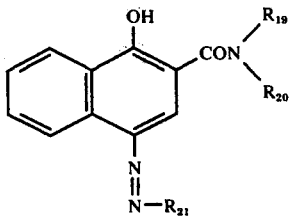

(XII)

-continued (XIII)

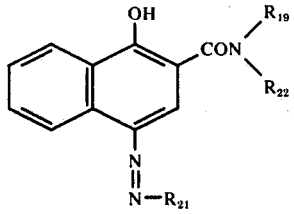

wherein $R_{19}$ and $R_{20}$ each represents an alkyl group having 1 to 20 carbon atoms, preferably 6 to 20 carbon atoms, which can further be substituted with another substituent (a typical example including an n-hexyl group, an n-octyl group, a 2-ethylhexyl group, an n-dodecyl group, an n-octadecyl group, a γ-(n-dodecyloxy)-n-propyl group, a γ-(2,4-di-t-amylphenoxy)butyl group, etc.); $R_{21}$ represents a monocyclic aryl group having at least one of an alkoxycarbonyl group or an aryloxycarbonyl group as a substituent; and $R_{22}$ represents an aryl group (preferably, a phenyl group or a naphthyl group, which can be further substituted with other substituents).

Of the colored cyan couplers represented by the general formula (IX), particularly useful coupler compounds are shown below.

(31)

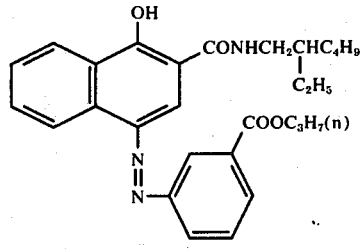

(32)

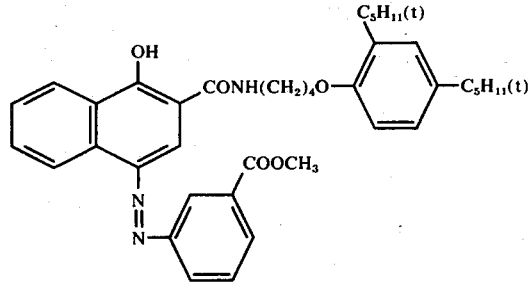

Of the colored cyan couplers represented by the following general formula (X), a particularly useful coupler compound is shown below.

(33)

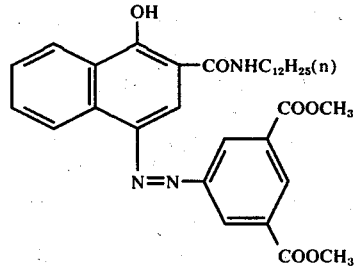

Of the colored cyan couplers represented by the following general formula (XI), particularly useful coupler compounds are illustrated below.

(34)

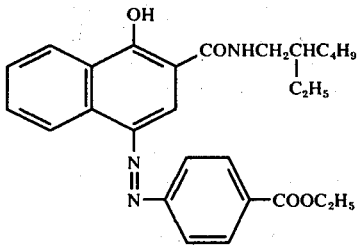

(35)

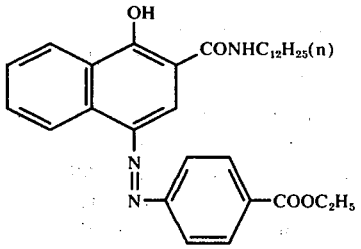

-continued
(36)
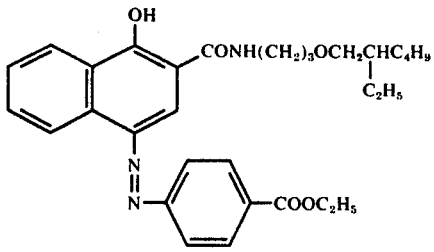
(37)
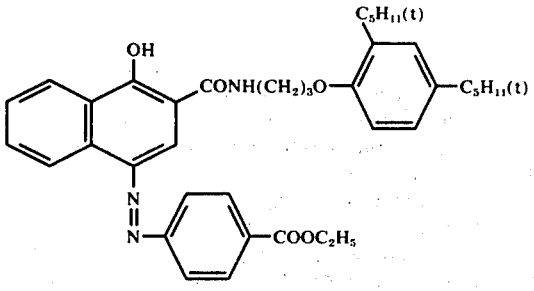
(38)
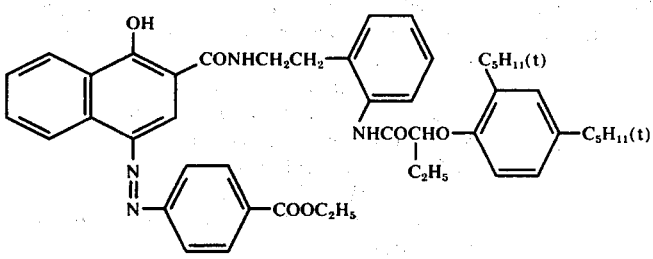
(39)
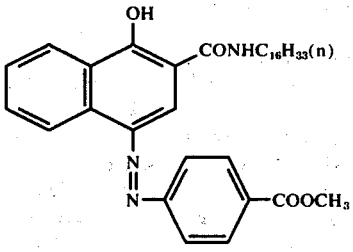
(40)
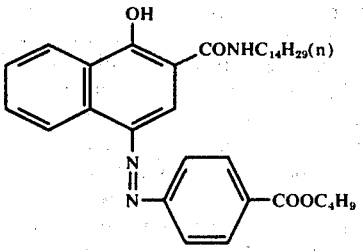
Of the colored cyan couplers represented by the general formula (XII), particularly useful coupler compounds are:
(41)
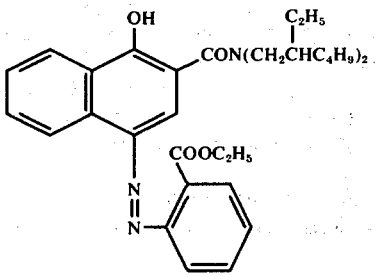
-continued
(42)
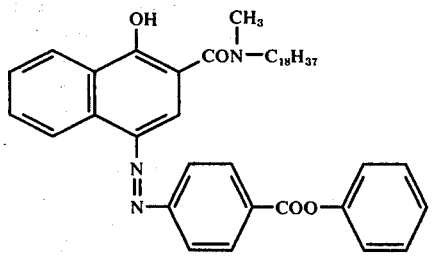
Of the colored cyan couplers represented by the general formula (XIII), a particularly useful coupler compound is (43)

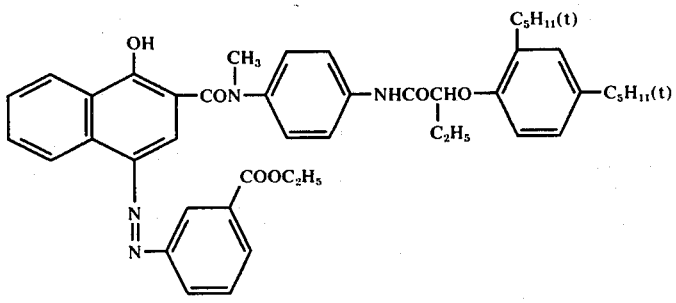

As the colorless cyan couplers of the present invention, a wide variety of couplers can be used. For example, coupler compounds having 15 to 44 carbon atoms and having substantially no absorption in the visible light range can be selected from conventionally known cyan couplers (for example, as described in W. Pelz, *Mitteilungen aus den Forschungs-Laboratorien der Afga Leverkusen Munchen III*, pp. 156–174 (1961)). In particular, coupler compounds represented by the following general formula (XIV) or (XV) provide good results, (XIV)

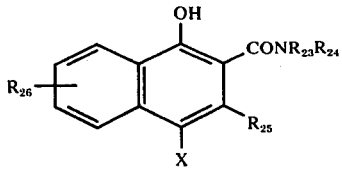

(XV)

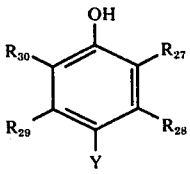

wherein $R_{23}$ and $R_{24}$ each represents a hydrogen atom, an alkyl group (preferably a straight or branched chain alkyl group having 1 to 30 carbon atoms), a cyclic alkyl group (e.g., a cyclohexyl group, a norbornyl group, etc.), an aryl group (e.g., a phenyl group, a terphenyl group, a naphthyl group, etc.), a heterocyclic group (e.g., a benzimidazolyl group, a benzothiazolyl group, etc.), or in combination the non-metallic atoms necessary for forming a heterocyclic ring such as morpholine or piperidine, the alkyl group, aryl group, heterocyclic group or the like may be substituted with a halogen atom, a nitro group, a hydroxy group, a carbonyl group, an amino group (e.g., an amino group, an alkylamino group, a dialkylamino group, an anilino group, an N-alkylanilino group, etc.), an aryl group, an alkoxycarbonyl group, an aryloxycarbonyl group, an amido group (e.g., an acetamido group, a butyramido group, an ethylsulfonamido group, an N-methyl-benzamido group, an N-propylbenzamido group, a 4-t-butylbenzamido group, etc.), a carbamyl group (e.g., a carbamyl group, an N-octadecylcarbamyl group, an N,N-dihexylcarbamyl group, an N-methyl-N-phenylcarbamyl group, a 3-pentadecylphenylcarbamyl group, etc.), a sulfamyl group (e.g., an N-propylsulfamyl group, an N-tolylsulfamyl group, etc.), an alkoxy group (e.g., an ethoxy group, an octadecoxy group, etc.), an aryloxy group (e.g., a phenoxy group, a tolyloxy group, a naphthyloxy group, etc.), a sulfo group, a sulfonyl group (e.g., a methylsulfonyl group, an octadecylsulfonyl ethoxysulfonyl group, a decoxysulfonyl group, a phenylsulfonyl group, a tolysulfonyl group, a phenoxysulfonyl group, etc.), or the like; $R_{27}$ represents a hydrogen atom, a halogen atom (e.g., a chlorine atom, a bromine atom, etc.) an alkyl group (e.g., having 1 to 32 carbon atoms such as a methyl group, a dodecyl group, etc.), an aryl group, a heterocyclic group, an amino group (e.g., an amino group, an alkylamino group, an arylamino group, a heterocyclic amino group, etc.), a carbonamido group (e.g., an alkylcarbonamido group, an arylcarbonamido group, a heterocyclic carbonamido group, etc.), a sulfonamido group (e.g., an alkylsulfonamido group, an arylsulfonamido group, a heterocyclic sulfonamido group, etc.), a sulfamyl group (e.g., an alkylsulfamyl group, an arylsulfamyl group, a heterocyclic sulfamyl group, etc.), a carbamyl group (e.g., an alkylcarbamyl group, an arylcarbamyl group, a heterocyclic carbamyl group, etc.), an ureido group (e.g., an N-alkylureido group, an N-arylureido group, etc.), where the alkyl group, aryl group or heterocyclic group can contain the substituents described above with respect to $R_{23}$ and $R_{24}$, $R_{25}$, $R_{26}$, $R_{28}$, $R_{29}$ and $R_{30}$ each represents the groups as described with respect to $R_{27}$, and further represents a halogen atom (e.g., a chlorine atom, a bromine atom, etc.) or an alkoxy group (e.g., a methoxy group, a dodecyloxy group, etc.), X and Y each represents a hydrogen atom, a group capable of being eliminated upon coupling (e.g., a halogen atom, a thiocyano group, an alkoxy group, an aryloxy group, etc.), or X may be a cyclic imido group (e.g., a maleimido group, a succimido group, a 1,2-dicarboxyimide group, a phthalimido group, etc.) or a residue capable of releasing a restrainer upon development (e.g., an arylmonothio group, a heterocyclic thio group, a 2-benzotriazole group, a 2-benzodiazole group, and arylsulfinyl group, etc.).

More specifically, those colorless cyan couplers as described in U.S. Pat. Nos. 2,369,929, 3,591,383, 3,458,315, 2,474,293, 2,908,573, 3,419,390, 3,476,563, 3,253,924, 2,434,272, 3,516,831, 3,311,476, 2,698,974, 3,227,554, 3,701,783, 3,617,291, 3,622,328, 2,908,573, Japanese Pat. Publication Nos. 5547/64, 6993/70, 12988/63, 18145/63, 28836/70, 19032/71, Japanese Pat. Application Nos. 35379/73, 69383/73, West German Pat. OLS Nos. 2,216,578, 2,163,811, etc. are preferred as colorless cyan couplers.

Further, specific compounds particularly preferred as the colorless cyan couplers are illustrated by the following.

(44)
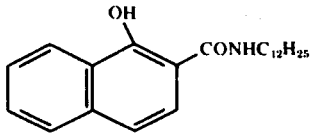
(45)
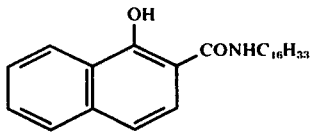
(46)
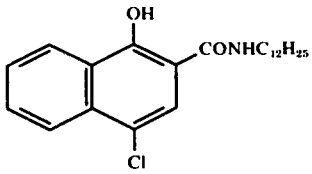
(47)
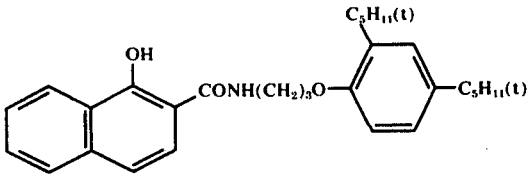
(48)
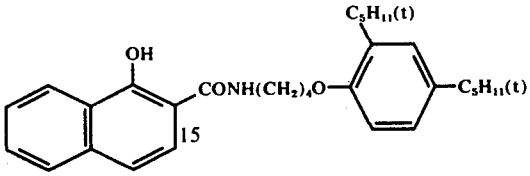
(49)
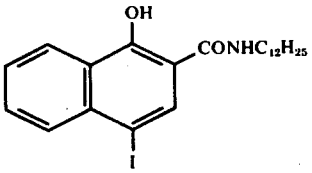
(50)
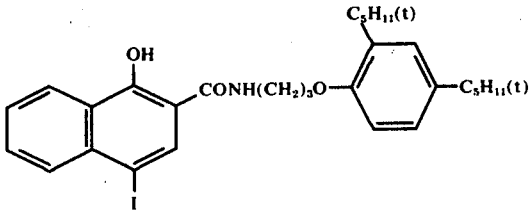
(51)
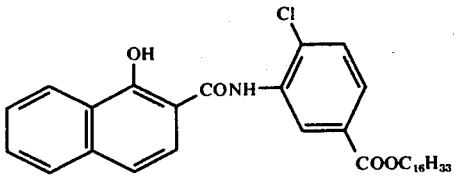
(52)

-continued
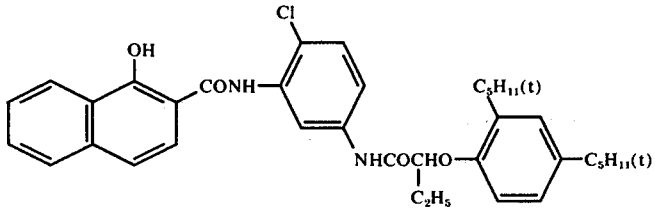
(53)
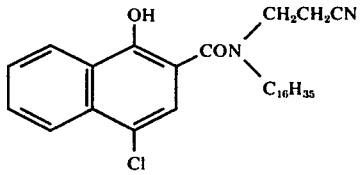
(54)
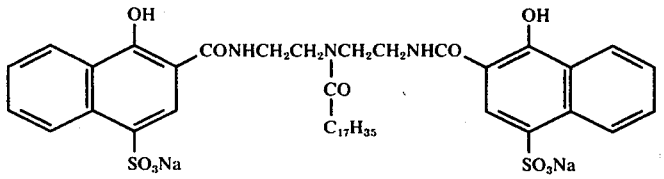
(55)
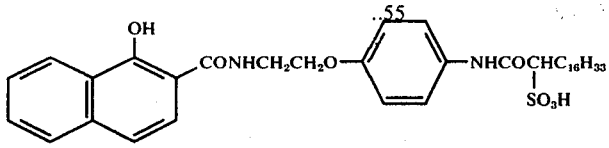
(56)
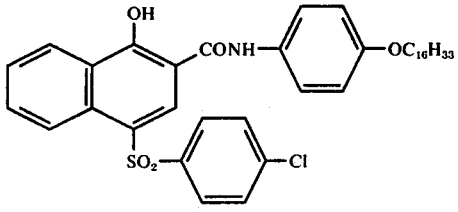
(57)
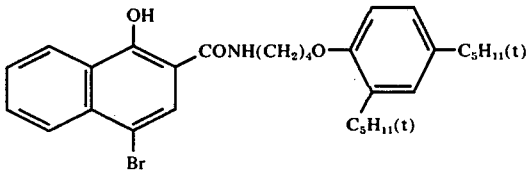
(58)
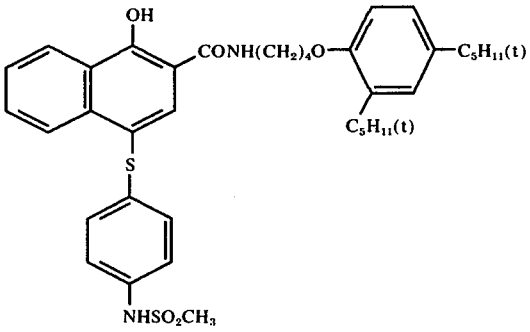

-continued
(59)
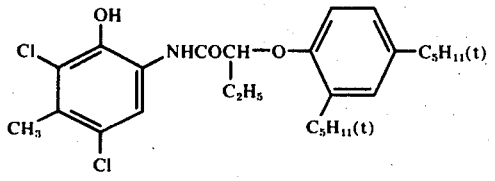
(60)
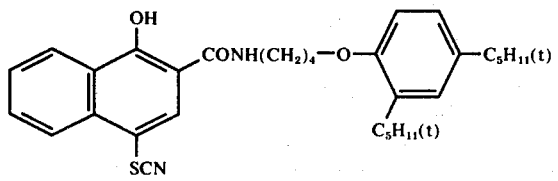
(61)
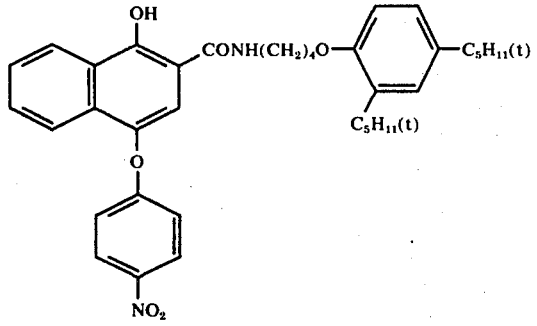
(62)
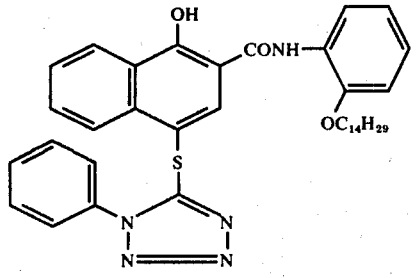
(63)
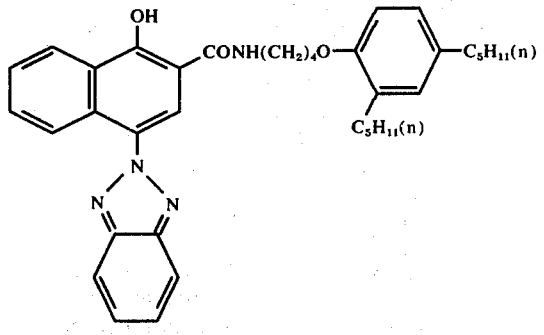

(64)

-continued

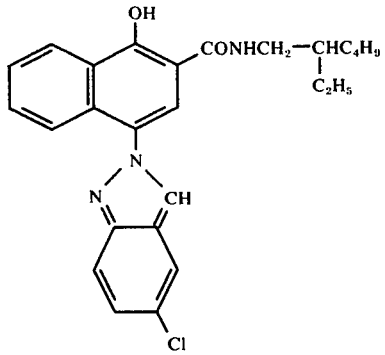

Three couplers of the present invention, i.e., a colored cyan coupler having a main absorption in the blue region, a colored cyan coupler having a main absorption in the green region and a colorless cyan coupler, as described before are incorporated in a red-sensitive layer and are desirably incorporated in the same red-sensitive layer of the color photographic light-sensitive material. However, it is possible to incorporate two of them in the same red-sensitive layer and the third in a different red-sensitive layer. Also, it is possible to incorporate the couplers independently in three different red-sensitive layers.

On the other hand, the following configurations are suitable for the light-sensitive material of the present invention. That is, in a color photographic light-sensitive material having a stratum structure comprising a red-sensitive layer, a green-sensitive layer and a blue-sensitive layer, the red-sensitive layer is constituted as described in detail before, the green-sensitive layer can contain a colorless magenta coupler, a colored magenta coupler, a DIR magenta coupler and a non-coloring DIR compound as described in U.S. Pat. Nos. 3,379,529, 3,639,417, 3,297,445, 3,632,345, and the blue-sensitive layer can contain a colorless yellow coupler, a DIR yellow coupler and the above described non-coloring DIR compound.

With respect to the use of DIR couplers and/or DIR compounds in the red-sensitive layer, the green-sensitive layer and the blue-sensitive layer of the color light-sensitive material of the present invention, the processes described in U.S. Pat. No. 3,703,375, Japanese Patent Publication Nos. 28836/70, 19034/71, Japanese Pat. Application Nos. 50051/73, 68892/73, West German Pat. OLS Nos. 2,060,196, 2,322,165, etc. can be utilized. Also, with respect to the structure of auxiliary layers upon use of DIR couplers and/or DIR compounds, the processes described in U.S. Pat. 3,737,317, Japanese Pat. Application Nos. 73445/73, 103542/73 and 113633/73 are preferably used.

The amount of each of the colored cyan coupler having a peak in the blue light absorption region and of the colored cyan coupler having a peak in the green light absorption region in general, can range from about 0.02 to about 2 mols per 1 mol of the colorless cyan coupler. Preferably, the amounts range from 0.05 to 1.5 mols per mol of the colorless cyan coupler. A suitable molar ratio of silver to the colorless cyan coupler and the two types of colored cyan couplers is about 4:1 to 100:1, preferably 4:1 to 50:1.

When the molar proportion of the colored cyan coupler having an absorption peak in the blue light region to the colored cyan coupler having an absorption peak in the green light region is within the range of about 10:1 to 1:10, the effect of the present invention can be observed. However, in order to enhance the effect of the present invention to the fullest, a preferred molar ratio ranges from 2:1 to 1:2.

Useful magenta couplers which can be used in the present invention are those magenta couplers described in U.S. Pat. Nos. 3,253,924, 3,516,831, Japanese Pat. Laid-Open No. 5482/72, U.S. Pat. Nos. 2,600,788, 3,558,319, 2,439,098, Japanese Pat. Application No. 21454/73, British Pat. No. 1,293,640, U.S. Pat. 3,468,666, 3,419,391, Japanese Pat. Application No. 56050/73, U.S. Pat. Nos. 3,311,476, 3,061,432, Japanese Pat. Publication No. 2016/69, Japanese Pat. Application No. 33238/73, U.S. Pat. Nos. 3,148,062, 2,908,573, Japanese Pat. Application Nos. 35379/73, 69383/73, Japanese Pat. Publication No. 19032/71, German Pat. OLS No. 2,216,578, U.S. Pat. Nos. 3,227,554, 3,701,783, 3,617,291, etc. and, even more useful colored magenta couplers are those magenta couplers described in U.S. Pat. Nos. 2,434,272, 3,703,375, Japanese Pat. Publication No. 2016/69, U.S. Pat. No. 3,476,564, Japanese Pat. Application No. 45971/73, U.S. Pat. No. 3,476,560, etc. Illustrative examples of particularly useful colored magenta couplers are 1-(2,4,6-tri-chlorophenyl)-3-[3-(2,4-di-tert-amylphenoxyacetamido)benzamido]-4-(4-methoxyphenylazo)-2-pyrazolin-1-(2,4,6-trichlorophenyl)-3-3-[α-(2,4-di-tert-amylphenoxy)-butyramido]benzamido -4-(4-methoxyphenylazo)-2-pyrazolin-5-one, 1-(2,4,6-trichlorophenyl)-3-(2-chloro-5-tetradecanoylamidoanilino)-4-(4-hydroxy-3-methylphenylazo)-2-pyrazolin-5-one.

Yellow couplers which can be in the present invention are described in U.S. Pat. No. 3,253,924, Japanese Pat. Publication No. 18735/64, U.S. Pat. Nos. 2,728,658, 3,265,506, 3,369,895, 3,582,322, 3,725,072, West German Pat. OLS Nos. 1,956,281, 2,162,899, U.S. Pat. Nos. 3,408,194, 3,447,928, 3,415,652, West German Pat. OLS No. 2,213,461, Japanese Pat. Laid-Open No. 3039/73, British Pat. No. 1,204,680, U.S. Pat. Nos. 2,908,573, 3,510,306, 3,658,544, 3,730,722, Japanese Pat. Application Nos. 35379/73, 69383/73, West German Pat. OLS No. 2,216,578, U.S. Pat. Nos. 3,148,062, 3,227,554, 3,701,783, etc.

The couplers used in the present invention can be dissolved in an oily solvent such as tricresylphosphate and dispersed and emulsified in a hydrophilic colloid aqueous solution, such as a gelatin aqueous solution, in the presence of a suitable surface active agent. In this case, the couplers are desirably emulsified together with a colorless cyan coupler. However, it is also possible to separately emulsify them and then mix the individual coupler dispersions. Suitable processes for dispersion and emulsification are given in the foregoing patents.

The photographic light-sensitive material of the present invention desirably contains, as a red-sensitive layer, a silver halide emulsion layer containing a colored cyan coupler-containing emulsion. However, the present invention is not limited only to this embodiment.

A silver halide emulsion is usually prepared by mixing a solution of a water-soluble silver salt (e.g., silver nitrate, etc.) with a solution of a water-soluble halide (e.g., potassium bromide, etc.) in the presence of a water-soluble high polymer such as gelatin. Silver bromoiodide, silver chlorobromoiodide, silver bromide, etc. are usually used as the silver halide. The weight ratio of silver to the hydrophilic colloid generally ranges from about 1:10 to 5:1, preferably 1:5 to 3:1 in the emulsion to be used in the present invention. These silver halide grains can be prepared using known conventional processes. For example they can be prepared by the so-called single- or twin-jet process, controlled twin jet process, or the like. The mean grain size of the silver halide preferably ranges from 0.1 $\mu$ to 2.0 $\mu$. These photographic emulsions are also described in CEK Mees & T. H. James; *The Theory of Photographic Process*, Macmillan Co., New York (1966), P. Grafkides; *Chimie Photographique*, Paul Montel, Paris (1957), or similar references, and can be prepared using various processes commonly known, such as an ammonia process, a neutral process, an acidic process, etc.

After the formation of the silver halide grains, the system is washed with water to remove water-soluble salts (for example, potassium nitrate when silver bromide is formed from silver nitrate and potassium bromide) from the system. Then, heat treatment is effected in the presence of a chemical sensitizer such as sodium thiosulfate, N,N,N'-trimethylthiourea, a thiocyanate complex salt or thiosulfate complex salt of monovalent gold, stannous chloride, hexamethylenetetramine, etc. to increase the sensitivity without coarsening the grains. General processes for chemical sensitization and chemical sensitizers which can be used are described in the above-described references and in U.S. Pat. Nos. 1,574,944, 2,278,947, 2,399,083, 2,410,689, 2,448,060, 2,487,850, 2,518,698, 2,521,925, 2,521,926, 2,491,973, 2,540,806, 2,566,245, 2,566,263, 2,419,975, 3,189,458, 3,297,446, and 3,501,313.

Illustrative hydrophilic colloids which can be used as a binder for the silver halide are, e.g., gelatin, colloidal albumin, casein, cellulose derivatives (e.g., carboxymethyl cellulose, hydroxyethyl cellulose, etc.), saccharide derivatives (e.g., agaragar, sodium alginate, starch derivatives, etc.) synthetic hydrophilic colloids (e.g., polyvinyl alcohol, poly-N-vinyl pyrrolidone, acrylic acid copolymers, polyacrylamide, the derivatives or partially hydrolyzed products thereof, etc.). If desired, a compatible mixture of two or more of these binders can be used. Of these, the most generally used binder is gelatin. Gelatin can be replaced, partly or completely, by a synthetic high molecular substance, by a so-called gelatin derivative (prepared by processing and modifying gelatin with a compound having a group capable of reacting with the functional groups contained in the gelatin molecule (i.e., amino groups, imino groups, hydroxy groups or carboxy groups)), or by a graft polymer prepared by grafting a molecular chain of another high molecular substance onto gelatin.

The above-described red-sensitive photographic emulsions are provided with a red sensitivity by adding panchromatically sensitizing dyes as described in U.S. Pat. Nos. 3,511,664, 3,522,052, 3,527,641, 3,615,613, 3,615,632, 3,615,641, 3,617,293, 3,617,295, 3,635,721, 3,694,217, 3,743,510, etc. A green sensitivity can be provided to the green-sensitive layers by employing green sensitizing dyes as described in U.S. Pat. Nos. 2,688,545, 2,912,329, 3,397,060, 3,615,635, 3,628,964, 3,793,020, 3,656,959, 3,769,301, 3,814,609, West German Pat. OLS No. 2,121,780, Japanese Pat. Publication Nos. 4936/68, 14030/69, etc., and a blue sensitivity can be provided to the blue-sensitive layers by employing blue sensitizing dyes as described in U.S. Pat. Nos. 2,493,748, 2,519,001, 2,977,229, 3,480,434, 3,672,897, 3,703,377, etc.

To the above-described photographic emulsion can be added various compounds in order to prevent a reduction in sensitivity and formation of fog during production, during storage or during processing of the light-sensitive material. An extremely large number of such compounds is well known in the art, such as heterocyclic compounds including 4-hydroxy-6-methyl-1,3,3a,7-tetrazaindene, 3-methylbenzothiazole and 1-phenyl-5-mercaptotetrazole, mercury-containing compounds, mercapto compounds, metal salt compounds, and the like.

Examples of suitable compounds are described in CEK Mees & T. H. James; *The Theory of the Photographic Process*, 3rd. Ed. p. 344–6 Macmillan, New York (1966), and the original literature references cited therein and are also described in U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663-5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339, and British Pat. Nos. 893,428, 403,789, 1,173,609, and 1,200,188.

Surface active agents alone or in combination can be added to the above-described photographic emulsion. They are used as a coating aid but, in some cases, they are used for the improvement of sensitization and photographic properties, antistatic purposes and the prevention of adhesion.

These surface active agents can be classified into natural surface active agents such as saponin; nonionic surface active agents such as alkylene oxide compounds, glycerin compounds, glycidol compounds, etc.; cationic surface active agents such as higher alkylamines, quaternary ammonium salts, heterocyclic compounds (e.g., pyridine, etc.), phosphonium compounds, sulfonium compounds, etc.; anionic surface active agents having an acidic group such as a carboxylic acid group, a sulfonic acid group, a phosphoric acid group, a sulfuric ester group, a phosphoric acid ester group, etc.; and amphoteric surface active agents such as aminoacids, aminosulfonic acids, aminoalcohol sulfuric or phosphoric esters, etc.

Examples of suitable surface active compounds are described in, e.g., U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, West German Patent OLS No. 1,942,665, British Pat. Nos. 1,077,317, 1,198,450, etc. and in, e.g., Ryohei Oda; *Synthesis and Application of Surface Active Agents*, Maki Shoten, (1964), A.W. Schwartz et al; *Surface Active, Agents* Interscience Publication Inc., (1958), J. P. Sisley and P. J. Wood; *Encyclopedia of Surface Active Agents*, vol. 2, Chemical Publishing Co., (1964), and the like.

In order to increase the strength of coated layers a hardener can be incorporated in the above-described photographic emulsion. Illustrative examples of hardeners are, for example, ketone compounds (e.g., diacetyl, cyclopentanedione, etc.), compounds having a reactive halogen (e.g., bis(2-chloroethylurea), 2-hydroxy-4,6-dichloro-1,3,5-triazine, the compounds described in U.S. Pat. Nos. 3,288,775, 2,732,303, British Pat. Nos. 974,723, 1,167,207, etc.), compounds having a reactive olefin such as divinylsulfone 5-acetyl-1,3-diacryloylhexahydro-1,3,5-triazine, those compounds described in U.S. Pat. Nos. 3,635,718, 3,232,763, British Pat. Nos. 994,896, etc.; isocyanates as described in U.S. Patents 3,103,437; aziridine compounds as described in U.S. Pat. Nos. 3,017,280, 2,983,611, etc.; acid derivatives as described in U.S. Pat. Nos. 2,725,294, 2,725,295, etc.; carbodiimide compounds as described in U.S. Pat. No. 3,100,704, etc.; epoxy compounds as described in U.S. Pat. No. 3,091,537, etc.; isoxazole compounds as described in U.S. Pat. Nos. 3,321,313 and 3,543,292; halocarboxyaldehydes such as mucochloric acid, etc.; dioxane derivatives such as dihydroxydioxane, dichlorodioxane, etc.; and inorganic hardening agents such as chromium alum, zirconium sulfate, etc. Also, precursors of the above-described compounds such as the alkali metal bisulfite-aldehyde adducts, hydantoin methylol compounds, primary aliphatic nitroalcohols, etc. can be used in place of the above-described compounds.

The photographic emulsion layer used in the present invention can contain a light absorbent and a filtering dye as described in U.S. Pat. No. 3,547,640, etc. If desired, the dye may be mordanted.

This photographic emulsion can be coated on a support conventionally employed for photographic light-sensitive materials, such as a cellulose nitrate film, a cellulose acetate film, a cellulose acetate butyrate film, a cellulose acetate propionate film, a polystyrene film, a polyethylene terephthalate film, a polycarbonate film, etc. These supports can be transparent and also colored by the addition of a dye or a pigment. Also, those supports having a colored subbing layer coated thereon can be used as a support. A suitable coating amount of the silver halide emulsion ranges from about 10 to 150 mg of silver per 100 $cm^2$ of the support.

This photographic emulsion can be coated using a variety of coating methods including a dip-coating method, an air knife-coating method, a curtain-coating method and an extrusion coating method using a hopper as described in U.S. Pat. No. 2,681,294. If desired, two or more layers can be coated at the same time according to the method described in U.S. Pat. Nos. 2,761,791, 3,508,947, 2,941,898, 3,526,528, etc.

The color photographic light-sensitive material of the present invention is completed by coating, in sequence, a green-sensitive emulsion layer, a yellow filter layer and a blue-sensitive emulsion layer on the aforesaid red-sensitive emulsion layer coated on the support. The coating sequence of each emulsion layer can be altered. The color photographic material of the present invention can further contain usual light-insensitive layers (e.g., a protective layer, a filter layer, an interlayer, an anti-halation layer, a subbing layer, a backing layer, etc.).

The color photographic light-sensitive material of this invention can be exposed for about $10^{-4}$ to 10 seconds using sunlight, a tungsten lamp or a flash lamp. Ordinary color photographic processings can be applied to the color photographic light-sensitive material of the present invention. The photographic processings can be effected at a temperature of from about 20° C or lower to about 60° C or higher.

Suitable color developers are an alkaline aqueous solution having a pH of not less than about 8, preferably 9 to 13 and containing an aromatic primary amine developing agent. Typical examples of aromatic primary amine developing agents are p-phenylenediamine derivatives and the inorganic acid salts thereof such as N,N-diethyl-p-phenylenediamine, 2-amino-5-diethylaminotoluene, 2-amino-5-(N-ethyl-N-laurylamino)toluene, 4-[N-ethyl-N-(β-hydroxyethyl-)amino]aniline, 3-methyl-4-amino-N-ethyl-N-(β-hydroxyethyl)aniline, etc.; 4-amino-3-methyl-N-ethyl-N-(β-methanesulfoamidoethyl)aniline sesquisulfate monohydrate as described in U.S. Pat. No. 2,193,015; N-(2-amino-5-diethylaminophenylethyl)methanesulfonamide sulfate as described in U.S. Pat. No. 2,592,364; N,N-dimethyl-p-phenylenediamine hydrochloride; 3-methyl-4-amino-N-ethyl-N-methoxyethylaniline as described in Japanese Pat. Laid-Open No. 64933/73; and the like.

These color developing agents are described in detail in, e.g., L.F.A. Mason; *Photographic Processing Chemistry*, pp. 226–229 Focal Press, London, (1966).

Also, these color developing agents can be used in combination with 3-pyrazolidones.

After development, the silver images are converted to silver halide by bleaching and then the bleached silver dissolved away by fixing. Bleaching and fixing can be effected sequentially or at the same time using a bleach-fixing bath.

In the bleaching solution are incorporated various oxidizing agents. Typical examples of oxidizing agents are ferricyanides (e.g., a potassium salt, a sodium salt, an ammonium salt, etc.), water-soluble quinones (e.g., quinone, sulfophenylquinone, chloroquinone, methoxyquinone, 2,5-dimethoxyquinone, methylquinone, etc.), dichromates, nitrosophenol, water-soluble copper (II) salts (cupric chloride, cupric nitrate, copper (II) sulfate, etc.), simple water-soluble cobalt (III) (e.g., cobalt (III) chloride, ammonium cobalt (III) nitrate, etc.), a complex salt between a multivalent cation such as iron (III), cobal (III), copper (II), etc. and an organic acid (e.g., a metal complex salt of ethylenediaminetetraacetic acid, nitrilotriacetic acid, iminodiacetic acid, N-hydroxyethylethylenediaminetriacetic acid or a like aminopolycarboxylic acid, malonic acid, tartaric acid, malic acid, diglycolic acid or dithioglycolic acid; 2,6-dipicolinic acid-copper complex salt; etc.), peracids (e.g., an alkylperacid, a persulfate, permanganate, hydrogen peroxide, etc.), hypochlorite, chlorine, bromine, and the like.

These various bleaching agents are described in Japanese Pat. Publication Nos. 14035/70, 13944/66, 11068/66, U.S. Pat. Nos. 2,507,183, 2,529,981, 2,625,477, 2,748,000, 2,810,648, 2,705,201, British Pat. Nos. 982,984, 1,014,396, 1,032,024, 777,635, 717,139, 1,111,313, etc.

The fixing solution contains a suitable siver halide solvent such as a water-soluble thiosulfate (e.g., a potassium salt, a sodium salt, an ammonium salt, etc.), a water-soluble thiocyanate (e.g., sodium salt, potassium salt, ammonium salt, etc.), a water-soluble sulfur-containing diol fixing agent (e.g., 3-thia-1,5-pentanediol, 3,6-dithia-1,8-octanediol, 3,6,9-trithia-1,1,1-undecanediol, etc.), a water-soluble sulfur-containing organic dibasic acid (e.g., ethylenebisthioglycolic acid, thioglycolic acid, etc.) or the alkali metal salt of such a dibasic acid.

Ordinary additives for each processing solution can be incorporated in the color developer, the bleaching solution and the fixing solution.

The processing steps can include, in addition to the abovedescribed three basic steps of developing, bleaching and fixing, other steps (for example, a stopping bath, a hardening bath, a stabilizing attained washing, etc.), if desired. absorption According to the present invention, a color print with good color reproduction can be obtained. That is, suitable color correction of a cyan dye in a color negative image can be obtained through sufficient masking and, as a result, color stain-free color prints having distinct red and yellow images can be obtained. As a result, colored cyan couplers can be selected from a wide range of compounds taking into consideration only the difference in the bsorption peaks. Therefore, the present invention is advantageous in designing a color photographic emulsion.

The present invention is illustrated in greater detail by reference to the following examples. Unless otherwise indicated, all parts, percents, ratios and the like are by weight.

EXAMPLE 1

To 1,000 g of a high speed negative silver bromoiodide emulsion containing 6.5 g of silver bromoiodide (containing 6.0 mol% of silver iodide) and 10 g of gelatin were added, in sequence, 200 cc of a 0.03% methanol solution of the following optical sensitizer, 20 cc of a 1% aqueous solution of 5-methyl-7-hydroxy-1,3,4-triazaindolizine, 450 g of the following Emulsion (1) containing a colorless cyan coupler (Compound 44) and, as a gelatin hardener, 50 cc of a 2% aqueous solution of 2-hydroxy-4,6-dichloro-s-triazine sodium salt, to prepare a red-sensitive emulsion.

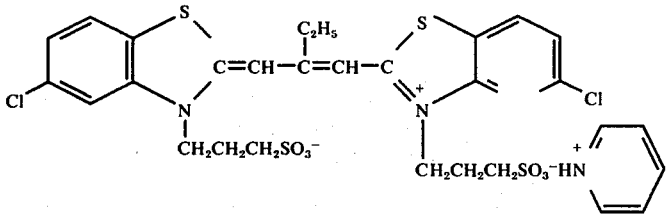

EMULSION (1)

A mixture comprising 110 cc of ethyl acetate, 80 g of Compound 44 (colorless cyan coupler), 5 g of sodium p-dodecylbenzene sulfonate and 65 cc of tricresylphosphate was melted at 60° C and added to 1,000 cc of a 10% aqueous solution of gelatin previously maintained at 60° C, followed by stirring for 20 minutes using a mixer for emulsification. Thus, Emulsion (1) was prepared.

The red-sensitive color emulsion obtained above was coated on a cellulose triacetate support having a subbing layer thereon, at a coverage of 20 mg/100 $cm^2$ of silver to prepare Color Photographic Film (A).

Film (A) was exposed to red light through a conventional gray wedge and subjected to the following color development processing.

Figure 2:
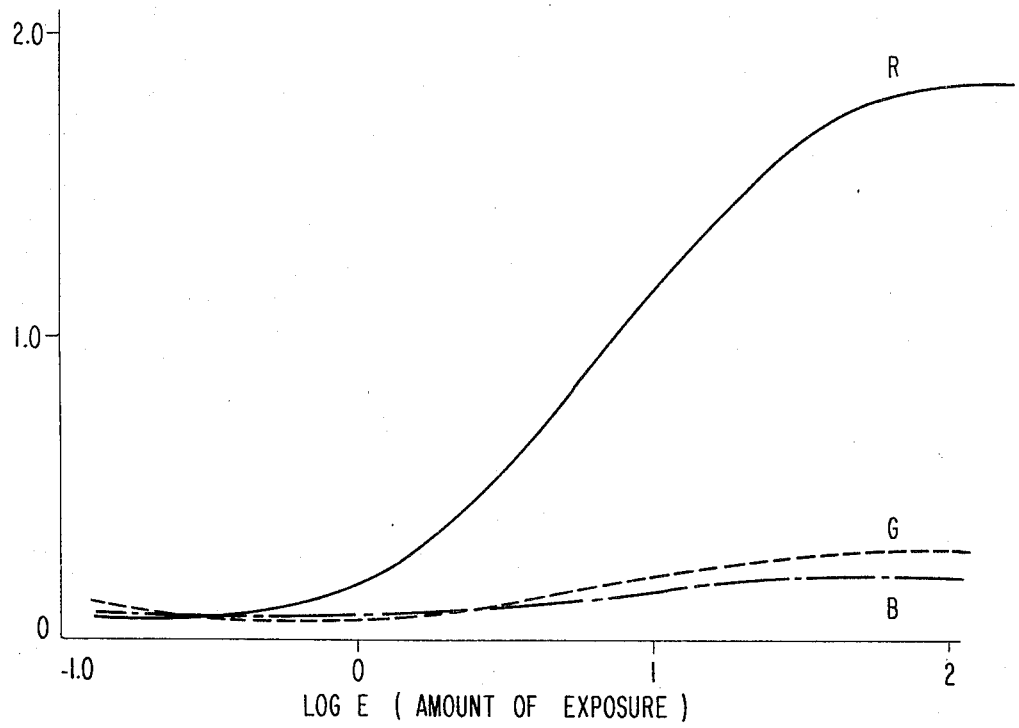
FIGS. 2 through 5 illustrate the color-correcting effect of the present invention, wherein Curves R, G and B show the characteristic curves of a cyan color image obtained by red photometry, green photometry and blue photometry, respectively.

The density of the developed film was measured through a red, green or blue filter to obtain the characteristic curves shown in FIG. 2.

From FIG. 2, it can be seen that, when only the colorless cyan coupler is used, a cyan dye having side-absorptions in the blue and green regions is formed.

| Development Processing Steps | Temperature | Time |
|---|---|---|
| Color Development | 24° C | 12 min. |
| Stopping Solution Bath | " | 4 |
| Hardening Bath | " | 4 |
| Washing | " | 4 |
| Bleaching Bath | " | 6 |
| Washing | " | 4 |
| Fixing Bath | " | 8 |
| Washing | " | 8 |
| Drying | " | |

The processing solutions used had the following formulations.

| Color Developer Solution | |
|---|---|
| Benzyl Alcohol | 5 ml |
| Sodium Hydroxide | 0.5 g |
| Diethylene Glycol | 3 ml |
| Sodium Hexametaphosphate | 2 g |
| Sodium Sulfite | 2 g |
| Potassium Bromide | 2 g |
| 4-Amino-3-methyl-N-ethyl-N-(β-hydroxyethyl)aniline Monosulfate | 5 g |
| Metaboric Acid | 0.5 g |
| Sodium Metaborate (tetrahydrate) | 77 g |
| Water to make | 1 liter |

| | |
|---|---|
| *Stopping Bath* | |
| Sodium Acetate | 30 g |
| Glacial Acetic Acid | 8 ml |
| Water to make | 1 liter |
| *Hardening Solution* | |
| Sodium Hexametaphosphate | 1 g |
| Borax (pentahydrate) | 20 g |
| Formalin (37%) | 10 ml |
| Water to make | 1 liter |
| *Bleaching Solution* | |
| Potassium Ferrocyanide | 8 g |
| Potassium Ferricyanide | 30 g |
| Potassium Bromide | 20 g |
| Borax (pentahydrate) | 15 g |
| Boric Acid | 5 g |
| Disodium Ethylenediaminetetraacetate Dihydrate | 1 g |
| Water to make | 1 liter |
| *Fixing Solution* | |
| Sodium Hexametaphosphate | 1 g |
| Sodium Sulfite | 5 g |

| | |
|---|---|
| Sodium Thiosulfate | 150 g |
| Acetic Acid | 8 ml |
| Water to make | 1 liter |

Next, Emulsion (2) was prepared in the same manner as Emulsion (1) except for using 65 g of Compound (44) and 15 g of Compound (21), as a colored cyan coupler of the invention having an absorption in a long wavelength region represented by the general formula (V), in combination in place of Compound (44). The spectral absorption spectrum of Compound (21) is shown in FIG. 1.

A photographic emulsion was prepared in the same manner as described above except for using Emulsion (2), and Color Photographic Film (B) was prepared therefrom. Film (B) was exposed, development-processed and subjected to densitometry in absolutely the same manner as described above, to obtain the characteristic curves as shown in FIG. 3.

Figure 3:
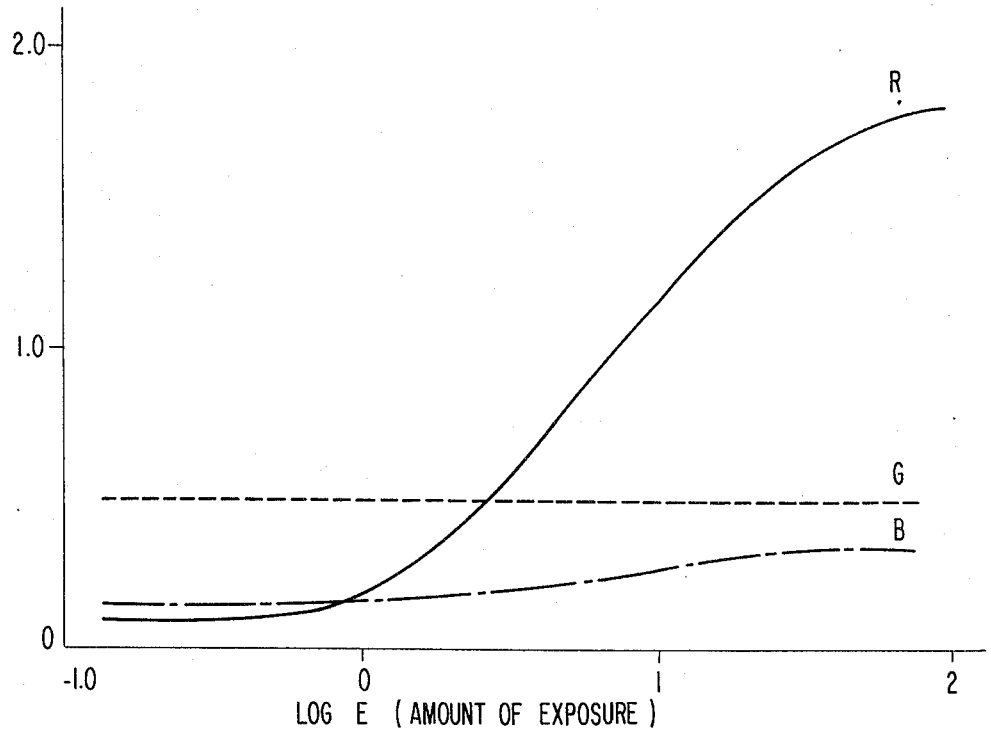

From FIG. 3, it can be seen that, when a colored cyan coupler having an absorption in the long wavelength region is used in combination with a colorless cyan coupler, the masking effect on the side-absorption in the blue region of the dye formed is insufficient although the masking effect on the side-absorption in the green region is sufficient.

Next, Emulsion (3) was prepared in the same manner as Emulsion (1) except for using 80 g of Compound (35) as a colored cyan coupler of the present invention having an absorption in a short wavelength region in place of Compound (44). The spectral absorption spectrum of Compound (35) is also shown in FIG. 1. A photographic emulsion was prepared in the same manner as described above except for using 70 g of Emulsion (3) and 380 g of Emulsion (1). Thus, Color Photographic Film (C) was obtained. Film (C) was exposed, development-processed and subjected to densitometry in absolutely the same manner as described above, to obtain the characteristic curves shown in FIG. 4.

Figure 4:
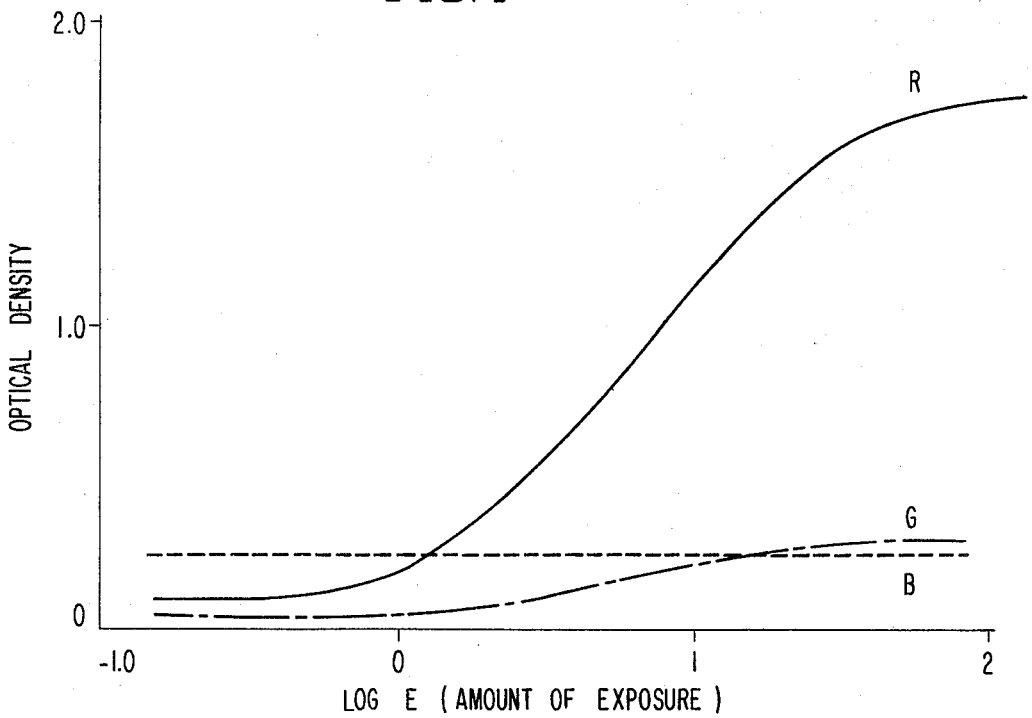

From FIG. 4, it can be seen that, when a colored cyan coupler having an absorption in a short wavelength region is used in combination with a colorless cyan coupler, the masking effect on the side-absorption in the green region of the cyan dye formed is insufficient although the masking effect on the side-absorption in the blue region is sufficient.

Next, Emulsion (4) was prepared in the same manner as Emulsion (1) except for using 65 g of a Compound (44) as a colorless cyan coupler, 15 g of a Compound (21), as a colored cyan coupler having an absorption in a short wavelength region, and 11 g of Compound (35) as a colored cyan coupler having an absorption in a short wavelength region. A photographic emulsion was prepared in the same manner as described above except for using Emulsion (4), and Color Photographic Film (D) was obtained therefrom. Film (D) was exposed, development-processed and subjected to densitometry in absolutely the same manner as described above, to obtain the characteristic curves as shown in FIG. 5.

Figure 5:
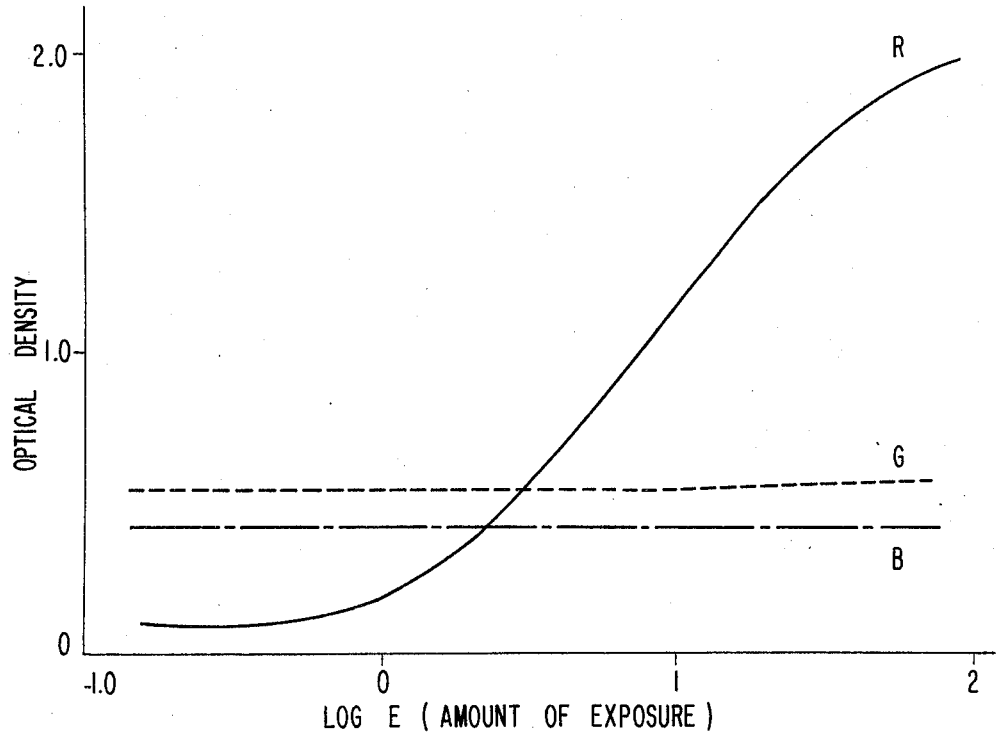

As is shown in FIG. 5, the side-absorptions of the formed cyan dye in the blue and green regions are sufficiently masked by using a colored cyan coupler having an absorption in a short wavelength region and a colored cyan coupler having an absorption in a long wavelength region, in combination.

EXAMPLE 2

Emulsion (5) was prepared in the same manner as Emulsion (1) except for replacing the cyan couplers by 12 g of a colored cyan coupler (Compound (41), 14 g of a colored cyan coupler (Compound (4)) and 65 g of a colorless cyan coupler (Compound (44)). As is shown in FIG. 1, the colored cyan coupler (Compound (41)) has a main absorption in the blue region, with an absorption peak at 485 mμ. On the other hand, colored cyan coupler (Compound (4)) has a main absorption in the green region, with the absorption peak at 503 mμ. The difference in the wavelength between both of the peaks is 18 mμ. A photographic emulsion was prepared in the same manner as described in Example 1 except for using Emulsion (5) to obtain Color Photographic Film (E). Further, Emulsion (6) was prepared in the same manner as Emulsion (5) except for completely replacing the colored cyan couplers by Compound (41). Separately, Emulsion (7) was obtained in the same manner as Emulsion (5) except for completely replacing the colored cyan couplers by Compound (4). Color Photographic Films (F) and (G) were obtained in the same manner using Emulsions (6) and (7), respectively.

Films (E), (F) and (G) were exposed, development-processed and subjected to densitometry in absolutely the same manner as in Example 1. As a result, the gammas of the cyan, magenta and yellow components of the image density appearing in characteristic curves were obtained.

| Film | Red-light Photometry Gamma (Cyan) | Green-light Photometry Gamma (Magenta) | Blue-light Photometry Gamma (Yellow) |
|---|---|---|---|
| E | 1.05 | 0.04 | 0.02 |
| F | 1.00 | 0.12 | 0.01 |
| G | 1.08 | 0.02 | 0.07 |

Gamma = slope of characteristic curve at a linear portion

The gamma of the cyan dye image of all of Films (E), (F) and (G) measured using red light photometry was almost 1. However, with Film F containing only two couplers, a colored cyan coupler (compound 41)) having a main absorption in the blue region and a colorless cyan coupler (Compound (44)), the gamma of the magenta image in the green light region was as large as 0.12 showing that masking was insufficient, although the gamma of the yellow image in the blue region was 0.01 which was substantially zero showing that masking in this region was sufficient. On the other hand, with Film (G) containing only two couplers, a colored cyan coupler (Compound (4)) having a main absorption in the green region and a colorless cyan coupler (Compound (44)), the gamma of the yellow image in the blue region was as large as 0.07 showing that masking was insufficient, although the gamma of the magenta image in the green region was 0.02 which was nearly zero showing that masking at this region was sufficient.

With Film (E) containing three couplers, a colored cyan coupler (Compound (41)) having a main absorption in the blue region, a colored cyan coupler (Compound (4)) having a main absorption in the green region and a colorless cyan coupler (Compound (44)), the gamma value of the yellow image in the blue region and that of the magenta image in the green region were 0.02 and 0.04, respectively, which were both nearly zero showing that masking was sufficient in both regions.

That is, the above-described results show that unnecessary absorption components can be sufficiently masked as long as the difference in wavelength of the peaks of absorption of both of the colored couplers is 18 nm, as is shown by the peak difference between the Colored Cyan Coupler (41) having a main absorption in a blue region shorter than 490 nm and the Colored Cyan Coupler (Compound (4)) having a main absorption in the green region lying in a longer side.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon at least one silver halide emulsion and the light-sensitive material containing a colored cyan coupler having a main absorption in the blue region of the spectrum, a colored cyan coupler having a main absorption in the green region of the spectrum, and a colorless cyan coupler, each coupler being capable of coupling with an oxidation product of a p-phenylenediamine color-developing agent to form a cyan dye and being present in a red-sensitive silver halide emulsion layer, said colored cyan coupler having a main absorption in the green region of the spectrum being a coupler represented by the following general formula (I)

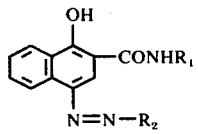

(I)

wherein $R_1$ represents an aryl group; $R_2$ represents an aryl group having at least one of an alkoxycarbonyl group, an aryloxycarbonyl group, an alkylcarbonyl group or an arylcarbonyl group as a substituent; or the following general formula (II)

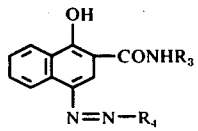

(II)

wherein $R_3$ represents an alkyl group; $R_4$ represents a monocyclic aryl group containing an alkoxycarbonyl group, an aryloxycarbonyl group, an alkylcarbonyl group or an arylcarbonyl group at the o-position with respect to the azo group; said colored cyan coupler having a main absorption in the blue region of the spectrum being a coupler repesented by the following general formula (VII)

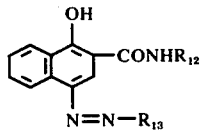

(VII)

wherein $R_{12}$ represents an alkyl group; and $R_{13}$ represents a monocyclic aryl group having an alkoxycarbonyl group or aryloxycarbonyl group at the m- or p-position with respect to the azo group; or the general formula (VIII)

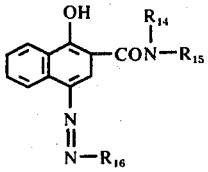

(VIII)

wherein $R_{14}$ represents an alkyl group; $R_{15}$ represents an alkyl group or an aryl group; $R_{16}$ represents a monocyclic aryl group having at least one of an alkoxycarbonyl group or an aryloxycarbonyl group as a substituent; and said colorless cyan coupler being a coupler represented by the following general formula (XIV) or (XV)

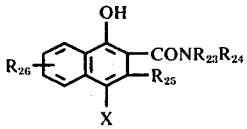

(XIV)

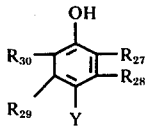

(XV)

wherein $R_{23}$ and $R_{24}$ each represents a hydrogen atom, an alkyl group, a cyclic alkyl group, an aryl group, a heterocyclic group, or in combination the non-metallic atoms necessary for forming a heterocyclic ring; $R_{27}$ represents a hydrogen atom, an alkyl group, an aryl group, a heterocyclic group, an amino group, a carbonamido group, a sulfonamido group, a carbamyl group, or a ureido group; wherein $R_{25}$, $R_{26}$, $R_{28}$ $R_{29}$ and $R_{30}$ each represents the groups as described with respect to $R_{27}$ and further represents a halogen atom or an alkoxy group; X and Y each represents a hydrogen atom, or a group capable of being eliminated on coupling with the oxidation product of an aromatic primary amine developing agent or X is a cyclic imido group or a residue capable of releasing a restrainer upon development.

2. The color photographic light-sensitive material of claim 1, wherein said colored cyan coupler having a main absorption in the blue region of the spectrum has an absorption peak in the wave length range of about 390 to 490 nm and wherein said colored cyan coupler having a main absorption in the green region of the spectrum has an absorption peak in the wave length range of about 490 to 550 nm.

3. The color photographic light-sensitive material of claim 1, wherein the wave length difference between (1) the peak of the absorption of the colored cyan coupler having a main absorption in the blue region of the spectrum and (2) the peak of the absorption of the colored cyan coupler having a main absorption in the green region of the spectrum is not less than about 18 nm.

4. The color photographic light-sensitive material of claim 3, wherein the wave length difference is not less than about 10 nm.

5. The color photographic light-sensitive material of claim 1, wherein said colored cyan coupler having a main absorption in the green region of the spectrum is a coupler represented by the following general formula (III)

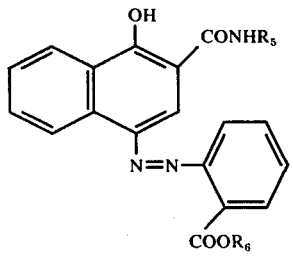

(III)

wherein $R_5$ represents a branched alkyl group having 6 to 22 carbon atoms; and $R_6$ represents a lower alkyl group having 1 to 6 carbon atoms; the following general formula (IV)

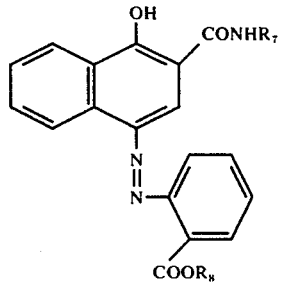

(IV)

wherein $R_7$ represents a monocyclic aryl group having at least one alkoxycarbonyl group having 9 to 22 carbon atoms; and $R_8$ represents a lower alkyl group having 1 to 6 carbon atoms; the following general formula (V)

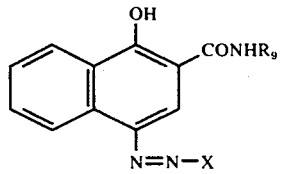

(V)

wherein $R_9$ represents a naphthalene ring residue connected to the amido group of the $\alpha$-position thereof; and X represents an aryl group having at least one alkoxycarbonyl group containing 1 to 22 carbon atoms; or the general formula (VI)

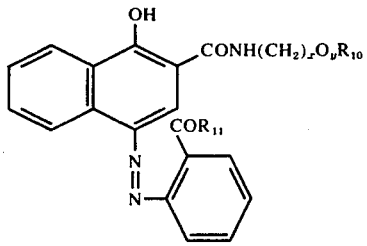

(VI)

wherein x represents an integer of 0 to 4; y represents 0 or 1; $R_{10}$ represents an aryl group or an alkyl group having 6 to 22 carbon atoms; and $R_{11}$ represents an alkyl group having 1 to 4 carbon atoms; and said colored cyan coupler having a main absorption in the blue region of the spectrum is a coupler represented by the following general formula (IX)

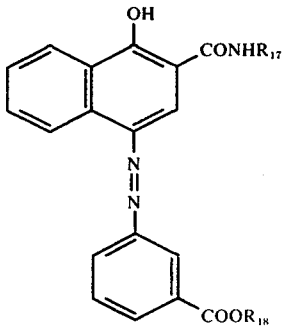

(IX)

wherein $R_{17}$ represents an alkyl group having 6 to 32 carbon atoms; and $R_{18}$ represents an alkyl group having 1 to 20 carbon atoms; the following general formula (X)

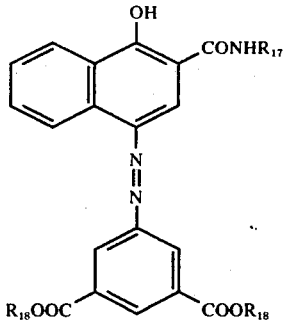

(X)

wherein $R_{17}$ and $R_{18}$ are the same as defined above; the following general formula (XI)

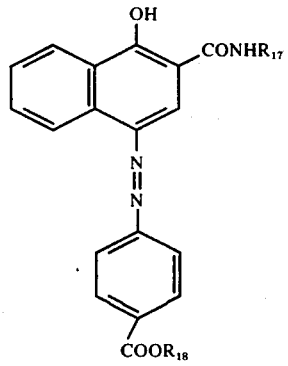

(XI)

wherein $R_{17}$ and $R_{18}$ are the same as defined above; the following general formula (XII)

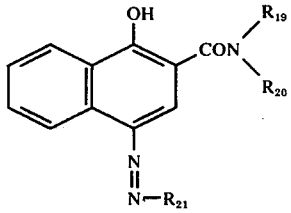

(XII)

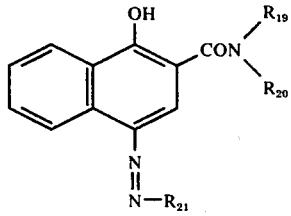

(XIII)

wherein $R_{19}$ and $R_{20}$ each represents an alkyl group having 1 to 20 carbon atoms; $R_{21}$ represents a monocyclic aryl group having at least one of an alkoxycarbonyl group or an aryloxycarbonyl group as a substituent; and $R_{22}$ represents an aryl group.

6. The color photographic light-sensitive material of claim 1, wherein each of said couplers is incorporated in a different red-sensitive silver halide emulsion layer.

7. The color photographic light-sensitive material of claim 1, wherein two of said couplers are incorporated in the same red-sensitive silver halide emulsion layer and the third of said couplers is incorporated in a different red sensitive silver halide emulsion layer.

8. The color photographic light-sensitive material of claim 1, wherein all of said couplers are incorporated in the same red-sensitive silver halide emulsion layer.

9. The color photographic light-sensitive material of claim 1, wherein the amount of each of the colored cyan coupler having a main absorption in the blue region of the spectrum and of the colored cyan coupler having a main absorption in the green region of the spectrum ranges from about 0.02 to about 2 moles per mol of the colorless cyan coupler; and wherein the molar ratio of silver to the colorless cyan coupler, the colored cyan coupler having a main absorption in the blue region of the spectrum and the colored cyan coupler having a main absorption in the green region of the spectrum ranges from about 4:1 to 100:1.

10. The color photographic light-sensitive material of claim 9, wherein the molar proportion of the colored cyan coupler having a main absorption in the blue region of the spectrum to the colored cyan coupler having a main absorption in the green region of the spectrum ranges from about 10:1 to 1:10.

* * * * *